United States Patent [19]

Green

[11] Patent Number: 4,757,905

[45] Date of Patent: Jul. 19, 1988

[54] HAT RACK

[76] Inventor: Rodney K. Green, P.O. Box 629, Glendive, Mont. 59330

[21] Appl. No.: 44,294

[22] Filed: Apr. 30, 1987

[51] Int. Cl.[4] ..... A47F 7/06

[52] U.S. Cl. ..... 211/31; 223/24; 2/180; 248/276

[58] Field of Search ..... 211/31, 30, 2, 87, 86; D6/315, 320, 411–415; 223/24; 2/180; 248/276

[56] References Cited

U.S. PATENT DOCUMENTS

| | | | |
|---|---|---|---|
| 687,706 | 11/1901 | Warner | 211/31 |
| 896,445 | 8/1908 | Fredericks . | |
| 1,124,714 | 1/1915 | Denning . | |
| 1,171,198 | 2/1916 | Hellberg | 248/304 X |
| 1,231,635 | 7/1917 | Nelson | 211/182 X |
| 1,570,451 | 1/1926 | Simoneau . | |
| 1,751,198 | 3/1930 | Franck . | |
| 1,953,396 | 4/1934 | Dunn | 211/32 |
| 1,965,773 | 7/1934 | Jacobs | 211/30 X |
| 2,255,973 | 9/1941 | Hoobler | 211/86 |
| 2,440,873 | 5/1948 | Popp et al. | 248/276 |
| 2,466,722 | 4/1949 | May | 248/276 |
| 2,939,585 | 6/1960 | Burgin . | |
| 3,208,597 | 9/1965 | Hansen . | |
| 3,740,013 | 6/1973 | Bentley | 248/300 X |

*Primary Examiner*—J. Franklin Foss
*Assistant Examiner*—Sarah A. Lechok Eley
*Attorney, Agent, or Firm*—Fleit, Jacobson, Cohn & Price

[57] ABSTRACT

A hat rack for effectively holding a hat in a manner and position simulative of the position that the hat would take when placed on a person's head and maintaining the shape of the hat without leaving any marks on the hat. The device includes a generally frustoconical hat form which is inserted into the hat with the form being generally oval shaped in plan configuration for shaping the hat. The device also includes a hanger bracket and adjustable arms forming a supporting linkage assembly to enable the hat to be supported from various supporting structures including but not limited to a vertical wall surface or the like, a horizontal desk or tabletop surface, the top edge of a seatback such as in a vehicle, on a dashboard of a vehicle, or in any other desired location with the adjustment features enabling the hat to be positioned generally in the attitude that the hat would assume when placed on a person's head.

9 Claims, 1 Drawing Sheet

12
16
32
26
18
20
30
34
54
56
24
22
38
28
10
40
14

52
22
50
40
48
50
46
38
42
44

26
36
34
60
72
74
76
68
28

62
66
54
58
64
60
70
68
74
56
62
64
66
56

62
64
66
54
56
58

54'
84
86
54'
78
80

HAT RACK

BACKGROUND OF THE INVENTION

1. Field of the Invention

The present invention generally relates to a hat caddy and more specifically to a device for effectively holding a hat in a manner and position simulative of the position that the hat would take when placed on a person's head and maintaining the shape of the hat without leaving any marks on the hat. The device includes a generally frustoconical hat form which is inserted into the hat with the form being generally oval shaped in plan configuration for shaping the hat. The device also includes a hanger bracket and adjustable arms forming a supporting linkage assembly to enable the hat to be supported from various supporting structures including but not limited to a vertical wall surface or the like, a horizontal desk or tabletop surface, the top edge of a seatback such as in a vehicle, on a dashboard of a vehicle, or in any other desired location with the adjustment features enabling the hat to be positioned generally in the attitude that the hat would assume when placed on a person's head.

INFORMATION DISCLOSURE STATEMENT

Various types of hat holders have been provided to support hats conveniently in a position for easy access. However, such devices do not include structural arrangements capable of supporting a hat in the manner of the present invention. A separate information disclosure statement will be filed.

SUMMARY OF THE INVENTION

An object of the present invention is to provide a hat rack for effectively supporting a hat in a position and shape closely simulative to that which the hat assumes when placed on a person's head with the structure of the device including an upwardly tapering form which telescopes into the interior of a hat and supports and shapes it with the form being adjustably supported by a bracket or hanger and a plurality of adjustable arms forming an adjustable support assembly for supporting the form and the hat from various supporting structures in order to provide a versatile hat rack for supporting a hat from various supporting structures which may be encountered during those periods when a hat is not being worn.

Another object of the invention is to provide a hat rack in accordance with the preceding object in which the hanger is provided with structure which enables it to be supported from a vertical wall surface which may have a pair of headed fasteners mounted thereon with the bracket including double keyhole slots for sliding interlocking engagement with headed fasteners on such a wall surface.

A further object of the invention is to provide a hat rack in accordance with the preceding objects in which the form which telescopes into the hat is connected to the hanger by adjustable arm assemblies interconnecting opposite sides of the form with opposite edges of the hanger with the arms being pivotally adjustable to cooperate with the hanger to form a clamp-type support for engagement with the upper edge of a support member such as the upper edge of a seatback with the adjustable structure also enabling the hanger to be used as a supporting base on a horizontal or near horizontal surface such as a tabletop, desktop, dashboard of a vehicle and the like.

Still another object of the invention is to provide a hat rack in accordance with the preceding objects in which the adjustable interconnection between the components of the hat rack are alternatively provided with axially extending, frictionally engaged ribs to retain the arms in adjusted position or radially disposed, frictionally engaged ribs to retain the arms in adjusted position with the structure of the rack being relatively simple and inexpensive but yet dependable and long-lasting and effective for supporting a hat from various supporting structures in a stable and efficient manner so that the hat is supported in a position and shape similar to that the hat would assume when worn.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figures 1, 2, 3, 4, 5, 6:
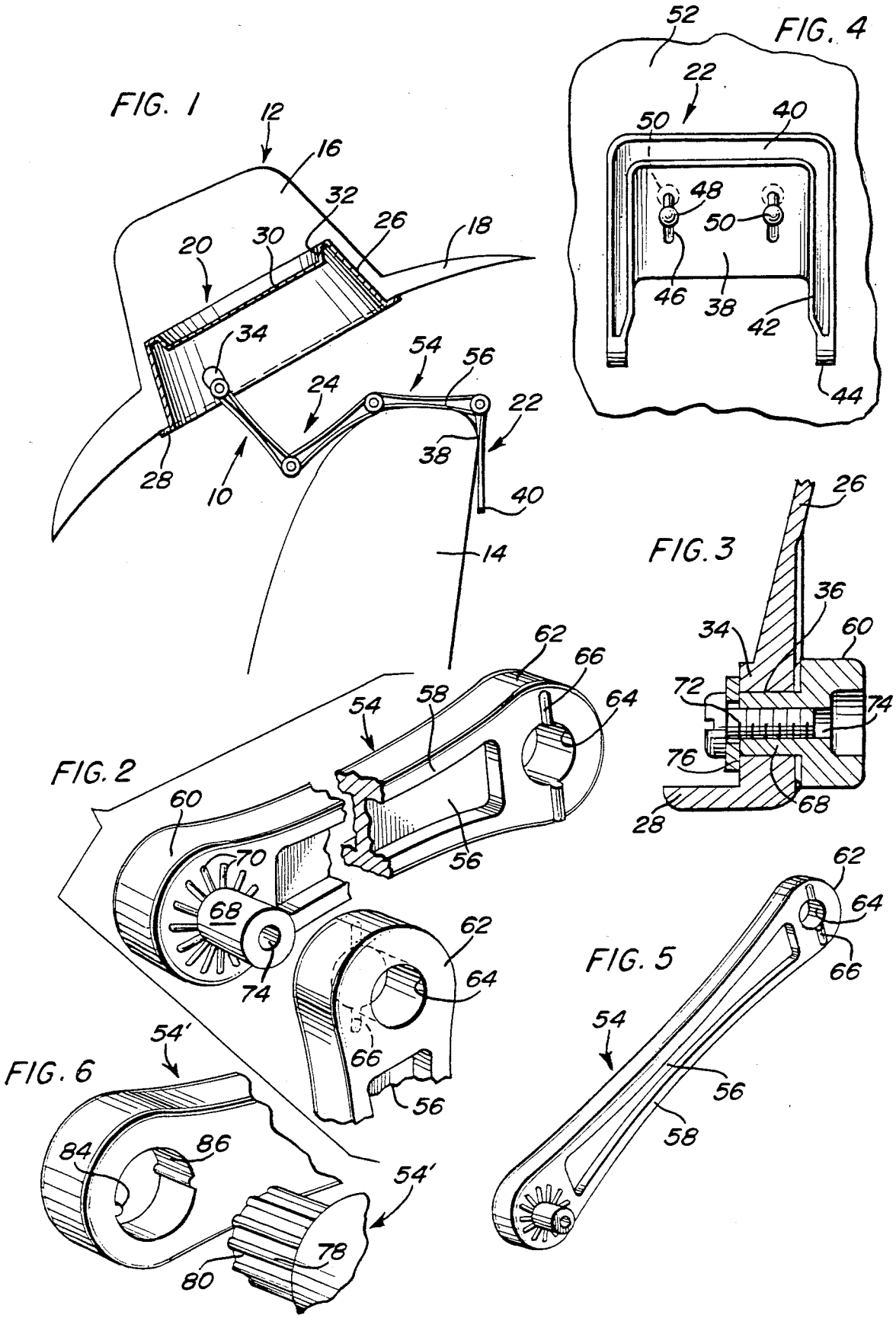
FIG. 1 is an elevational view of the hat rack of the present invention with the form being shown in section and the hat schematically illustrated with the hat rack positioned on the upper edge of a seatback.
FIG. 2 is an enlarged fragmental perspective view illustrating adjustable interconnection between adjacent supporting arms of the supporting assembly.
FIG. 3 is a vertical sectional view of the adjustable connection between the hat form and the supporting arm connected thereto.
FIG. 4 is an elevational view of the hanger illustrating the manner in which it is supported from a vertical wall surface.
FIG. 5 is a perspective view of one of the supporting arms.
FIG. 6 is a fragmental perspective view of an alternative arrangement for adjustably connecting the supporting elements of the hat rack.

Referring now specifically to the drawings, the hat rack of the present invention is generally designated by numeral 10 and, as illustrated in FIG. 1, supports a hat generally designated by numeral 12 from the upper edge of a seatback 14 which may be the seatback in a vehicle such as a pickup truck or the like, or the seatback of an upholstered chair or any other vertical support having a generally horizontally disposed top edge. The hat 12 is of conventional construction and may be a western style hat or any other similar type of shaped hat which includes a crown portion 16 and brim 18 in any desired configuration with the wearer of a hat normally desiring to support the hat during periods of nonuse. Conventionally, the hat is either supported by laying it brimside down onto a supporting surface or in some instances the hat is inverted and supported from the top of the crown both of which cause the hat to become misshaped and also permits the hat to move in the event it is placed in a vehicle or the like. For example, if the hat is merely laid on the seat beside a vehicle operator it frequently occurs that the hat will slide off of the vehicle seat during over-the-road movement of the vehicle thus causing the hat to become soiled and distorted from its desired shape. With the hat rack of the present invention installed on the seatback 14, the wearer of the hat can remove it from his head and place it on the hat rack in generally the same position and shape that it would assume when being worn thus not only supporting the hat in a stable manner in a desired position but also maintaining the shape and cleanliness of the hat.

The hat rack 10 includes a form 20 which telescopes into the open interior of the hat 12, a supporting hanger 22 spaced from the form 20 and an adjustable arm assembly 24 interconnecting the hanger 22 and the form 20 in order to support the form 20 and thus the hat 12 in a desired position and shape in relation to a supporting structure such as the seatback 14 as illustrated in FIG. 1.

The form 20 includes a peripherally continuous wall member 26 which tapers upwardly and inwardly from a bottom edge to a top edge with the bottom edge including an outwardly extending flange 28 disposed continuously peripherally thereof for engaging the undersurface of the hat crown where it joins with the brim so that the form 20 will be limited as to its telescopic insertion into the hat crown 16 as illustrated in FIG. 1. The upper end of the wall 26 is closed by a top wall 30 that is offset slightly inwardly from the top edge of the wall 26 as indicated by reference numeral 32. This structure may be a molded or otherwise formed plastic member of hollow construction provided with a roughened or matte exterior surface to effectively grip and support the interior headband or sweatband provided in the hat. Also, the plan configuration of the form 20 is generally oval shaped and simulative of the oval shape of the head so that the shape of the hat will be maintained while it is stored on the hat form. Also, opposite portions of the wall 26 offset toward the forward edge thereof are provided with a thickened boss 34 having an aperture 36 therethrough above the flange 28 as illustrated in FIG. 3 for connection with the supporting arm assembly 24 in a manner described hereinafter.

As illustrated in FIG. 4, the hanger 22 includes a plate 38 of generally rectangular configuration having a peripheral reinforcing edge member 40 extending across one long edge and two short edges of the plate 38 as illustrated in FIG. 4 with the reinforcing members extending beyond the opposite long edge of the plate 38 and generally defining arms 42 terminating in apertured supporting ears or lugs 44 which are spaced laterally from each other and in alignment with each other for connection with the supporting arm assembly 24 in a manner described hereinafter. The plate 38 includes a pair of parallel slots 46 therein which are provided with central larger apertures 48 for receiving headed fasteners 50 supported in a vertical wall surface 52 or any other supporting surface so that the plate 38 can be positioned downwardly over the headed fasteners 50 which pass through the apertures 48 with the plate 38 then being moved in either direction so that the headed fasteners 50 are received in one of the ends of the slot 46 to detachably secure the hanger to the supporting surface 52 with the headed fasteners 50 assuming the broken line position illustrated in FIG. 4. This enables the hanger to be slidingly interlocked with headed supporting fasteners in a vertical wall surface 52 or in a horizontal or inclined supporting surface thus providing a detachable hanger bracket for supporting the supporting arm assembly 24 and thus the form 20 and hat 12 from a supporting surface 52 by providing a positive connection to such a supporting surface but yet a connection which can be easily released so that the hat rack can be moved from one supporting location to another.

FIGS. 2, 3 and 5 illustrate the structural details of the supporting arm assembly 24 which includes a plurality of identical arms 54 interconnected with each other and having an end of one arm pivotally connected to the boss 34 at each side of the wall 26 of the form 20 and an end of another arm connected to an ear or lug 44 on each side of the hanger 22 with three or more arms 54 being provided between each side of the form 20 and each side of the hanger 22.

As illustrated in FIGS. 2 and 5, each of the arms 54 includes an elongated member 56 having reinforcing edge flanges 58 to form a generally H shape cross-sectional configuration with each end of the member 56 being generally enlarged and partially cylindrical with the two ends being desigated by numerals 60 and 62, respectively. The end 62 includes an aperture 64 therethrough and includes a pair of diametrically opposed ribs 66 extending radially from the periphery of the opening 64 on the axial surface of the generally cylindrical or curved end 62. The other end 60 of the arm 54 includes an integral cylindrical sleeve 68 having an external diameter permitting it to be inserted into an aperture 64. At the juncture of the inner end of the sleeve 68 and the axial surface of the end 60 on the member 58, a plurality of radially extending ribs 70 are provided on the axial surface so that when an end 62 of an adjacent arm 54 is assembled onto the bearing sleeve 68, the pair of opposed radial ribs 66 will coact with the radial ribs 70 to secure the connected arms in frictionally locked adjusted position. Likewise, as illustrated in FIG. 3, the arm end 60 has the sleeve 68 projecting through the aperture 36 and these components are maintained in assembled relation by the use of a headed self-tapping screw fastener 72 inserted into the sleeve 68 and screw threaded into the hollow interior 74 of the sleeve 68 as illustrated in Fib. 3 by its self-tapping feature with a standard washer 76 being provided under the headed fastener for engagement with the outer surface of the boss 34. Likewise, the connection between the adjacent arms 54 forming each side of the supporting arm assembly 24 are adjustably interconnected in the same manner and the supporting arms 54 are connected to the ears 42 on the hanger 22 in the same manner. With this construction, the friction ribs 66 coact with the friction ribs 70 to secure the individual arms 54 in angular relation to each other and secure the arms 54 adjustably to the form 20 and adjustably to the hanger 22 with all of these components being constructed of plastic material to facilitate inexpensive manufacture thereof with the resilient and memory characteristics of the plastic enabling the components to be adjusted usually without loosening the headed self-tapping screw fasteners 72. While dimensions may vary, the oval shaped, tapered wall 26 may have a major dimension of approximately $8\frac{3}{4}''$ at the bottom and $7\frac{1}{4}''$ at the upper end thereof and the minor dimension may be approximately $7''$ at the bottom and $5\frac{1}{2}''$ at the top although these dimensions may vary with the structure being preferably ABS plastic which is heat resistant and ultraviolet resistant. The bosses 34 are configured so that the apertures 36 therethrough are in direct alignment transversely of the form adjacent one end portion thereof as illustrated in FIG. 1 with the inner surface of the boss including a pair of friction ribs such as the friction ribs 66 formed thereon for matching engagement with the ribs 70 on the end 60 of the arm 54 connected therethrough.

FIG. 6 illustrates an alternative connection between the arms of the supporting assembly and the form 20 and between the assembly 24 and the hanger 22 in which the supporting arm 54' has a plurality of radial ribs 78 on a tubular sleeve 80 and the other end of the arm 54' is provided with a pair of friction ribs 84 formed on the internal surface of the aperture 86 extending therethrough with the arms being connected to each other and to the form and hanger in the same manner as illustrated in Fib. 3 with the friction ribs operating to permit adjustment and secure the components in adjusted position. As indicated previously, the components are all preferably constructed of plastic material except for the self-tapping screw fastener and washer with the structure of the supporting arm assembly and hanger being such that it can be completely enclosed within the bottom of the form and the supporting arm assembly and hanger 22 could be arranged so that the hanger 22 can form a supporting base for engagement with a substantially flat surface such as a tabletop, desktop or other generally horizontal supporting surface and the keyhole slot mounting arrangement enables the structure to be securely mounted on various inclined, curved, flat, horizontal or vertical surfaces thereby providing a highly versatile hat rack or holder and one which has substantial flexibility and use and will frictionally hold a hat of various sizes by virtue of the tapered configuration of the form and shape it in a manner simulative of the hat when worn by a person.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A hat rack comprising a hat form for telescopic insertion into the lower end of a hat, an adjustable supporting assembly connected to said form, and means connected to said supporting assembly remote from said form for supportingly engaging a support structure for supporting said hat in an accessible position, said supporting assembly including a pair of spaced identical parallel arm assemblies, said arm assemblies being positioned adjacent to and connected to opposite interior side portions of said hat form, each said arm assembly including a plurality of pivotally interconnected arms each of said arms forming one half of a set, each said arm assembly including a first pivotal connection between one set of endmost arms and said form and a second pivotal connection between another set of endmost arms, said means engaging a supporting structure, each said pivotal connection including a frictional locking arrangement to retain said arms in angularly adjusted relation to each other, in relation to said form and in relation to said means engaging said supporting structure.

2. The hat rack as defined in claim 1 wherein said form includes a peripherally continuous wall of oval shaped plan configuration with a first end of said wall inserted first into a crown portion of said hat and being of smaller dimension than the opposite end thereof to supportingly engage and shape hats of various sizes.

3. The hat rack as defined in claim 2 wherein said opposite end of said wall includes an outwardly extending flange to engage a lower surface of a brim portion of a hat outwardly of said crown portion to limit insertion of said form into said crown portion of said hat.

4. The hat rack as defined in claim 3 wherein said peripheral wall includes a closure end wall offset inwardly from said end of said wall inserted into said crown portion of said hat, said supporting arms pivotally connected to said form and being located in offset relation to the transverse center of said form and said hat positioned thereon and oriented internally of said peripheral wall.

5. The hat rack as defined in claim 1 wherein said means engaging a supporting structure includes a supporting plate having a pair of spaced parallel projecting ears on the edge thereof defining a third pivotal connection with said supporting arm assembly, said third pivotal connection enabling said plate to engage a generally flat or horizontal surface and serve as a supporting base and be adjusted in relation to said supporting arm assembly to cooperate with certain of said arms to provide a clamping engagement with an upper edge of a supporting structure such as a seatback of a vehicular seat.

6. The hat rack as defined in claim 5 wherein said plate includes a pair of keyhole shaped apertures therein for sliding interlocking connection with headed fasteners mounted on a supporting surface to provide a positive interlocking but detachable connection with a supporting surface.

7. The hat rack as defined in claim 1 wherein each of said pivotal connections includes an aperture in one member, a sleeve bearing in another member and a screw threaded element interconnecting said apertured member and said sleeve bearing and including interfacing and interengaging ribs on opposed surfaces of both of said members with both of said members and said ribs being constructed of plastic material enabling said ribs to move past each other but frictionally interengage to retain each of said pivotal connections in adjusted position.

8. The hat rack as defined in claim 7 wherein said ribs are on axially opposed surfaces of said members with said one member having a plurality of radial ribs and said another member having a single pair of diametrically opposed radial ribs.

9. The hat rack as defined in claim 7 wherein said ribs are disposed on internal and external cylindrical surfaces of said sleeve bearing with said internal surface of said sleeve bearing having a single pair of diametrically opposed ribs and said outer surface of said sleeve bearing having a plurality of outwardly projecting ribs.

* * * * *